US005697439A

United States Patent [19]

Kopfman et al.

[11] Patent Number: 5,697,439

[45] Date of Patent: Dec. 16, 1997

[54] ASSEMBLY AND METHOD FOR HANGING ELONGATED TUBING IN WELL BORE

[76] Inventors: Joseph R. Kopfman; Jimmy R. Kopfman, both of P.O. Box 280, Platteville, Colo. 80651; Dale Moulton, P.O. Box 935, Platteville, Colo. 80651

[21] Appl. No.: 596,872

[22] Filed: Feb. 13, 1996

[51] Int. Cl.[6] ..... F21B 33/04

[52] U.S. Cl. ..... 166/88.3

[58] Field of Search ..... 166/88.2, 88.3, 166/75.14, 382

[56] References Cited

U.S. PATENT DOCUMENTS

| | | | |
|---|---|---|---|
| 1,525,582 | 2/1925 | Hosmer | 166/88.3 X |
| 1,728,432 | 9/1929 | Mildren | 166/88.3 |
| 1,786,407 | 12/1930 | Humason | 166/88.3 X |
| 1,811,013 | 6/1931 | Humason | 166/88.3 |
| 2,312,487 | 3/1943 | Roach et al. | 166/88.3 X |
| 2,548,616 | 4/1951 | Priestman et al. | 255/4 |
| 2,567,009 | 9/1951 | Calhoun et al. | 166/1 |
| 3,116,781 | 1/1964 | Rugeley et al. | 153/54 |
| 3,182,877 | 5/1965 | Slator | 226/172 |
| 3,285,485 | 11/1966 | Slator | 226/172 |
| 3,373,818 | 3/1968 | Rike et al. | 166/77 |
| 3,797,570 | 3/1974 | Leutwyler | 166/77 |
| 3,827,487 | 8/1974 | Jackson et al. | 166/77 |
| 4,479,537 | 10/1984 | Reed | 166/77 |
| 4,844,166 | 7/1989 | Going, III et al. | 166/379 |
| 4,986,360 | 1/1991 | Laky et al. | 166/351 |
| 5,002,130 | 3/1991 | Laky | 166/351 |
| 5,027,903 | 7/1991 | Gipson | 166/382 |
| 5,088,559 | 2/1992 | Taliaferro | 166/379 |
| 5,092,400 | 3/1992 | Jusert | 166/88.2 |
| 5,148,865 | 9/1992 | Reed | 166/76 |
| 5,285,850 | 2/1994 | Bayh, III | 166/321 |

FOREIGN PATENT DOCUMENTS 1546609 2/1990 U.S.S.R. .

*Primary Examiner*—William P. Neuder
*Attorney, Agent, or Firm*—Flanagan & Flanagan

[57] ABSTRACT

An elongated tubing hanger assembly includes a bottom hanger sub installed upright on the well head of a well, a sealing assembly disposed within the bottom hanger sub, a slip bowl removably disposed within the bottom hanger sub immediately above and seated upon the sealing assembly, an annular retaining ring disposed about the upper periphery of the slip bowl to apply a force downward against the slip bowl, a running sub temporarily installed into an upper end portion of the bottom hanger sub to apply force downward against the slip bowl to compress and expand annular seal elements of the sealing assembly radially inward into a sliding sealing relationship with the tubing during its insertion, a slip element applied on the tubing and seated in an opening through the slip bowl to support the tubing in the well bore and to apply downward force, due to the weight of the tubing in the well bore, against the slip bowl to compress and expand the annular seal elements radially inward into the sealing relationship with the tubing, and a top hanger sub for attachment to the upper end portion of the bottom hanger sub after removal of the running sub. An elongated tubing hanging method includes the steps of installing the running sub in the bottom hanger sub during insertion of the tubing, then applying the slip element to the tubing and seating it in the slip bowl once the tubing is inserted, and finally removing the running sub and replacing it with a top hanger sub.

25 Claims, 3 Drawing Sheets

ASSEMBLY AND METHOD FOR HANGING ELONGATED TUBING IN WELL BORE

BACKGROUND OF THE INVENTION

1. Field of the Invention

The present invention generally relates to insertion of continuous elongated tubing into wells and, more particularly, is concerned with a method and assembly for hanging elongated tubing in a bore of a well.

2. Description of the Prior Art

Traditional methods of production of oil or gas from a well utilize sections of tubing interconnected in a tubing string that is disposed in the bore of the well. However, the use of elongated continuous tubing in oil and gas wells instead of a string of interconnected tubing sections is becoming more widespread. The elongated tubing is coiled on a reel and usually is thin-walled and of a relatively small diameter. A running tool is used to insert, or run, the tubing from the coil into the well bore.

While the tubing is being inserted into the well, it is desireable to form a seal at the well head about the tubing to prevent the escape of oil and/or gas from the well. Once a desired length of tubing is inserted into the well, it is preferably severed from the coil. This allows for movement of the running tool and/or the coil to another location and for attachment of additional equipment to the upper end of the tubing.

The need to maintain a seal at the well head about the tubing continues after the tubing is severed. Additionally, since the length of tubing is severed from the coil, there is a need to support, or hang, the tubing from the well head to prevent it from slipping further into the well bore under the force of its own weight.

Coil tubing hanging arrangements have been provided heretofore for forming and maintaining the seal both during and after tubing insertion and for supporting the tubing at its upper end portion from the well head. These arrangements use various approaches to providing an annular seal in a hanger body surrounding the tubing at the well head. One approach is to use an annular rubber bladder held in place in the hanger body with a snap ring. The disadvantage with this approach is there is no means to adjust the pressure imposed by the rubber bladder on the tubing as the tubing is being inserted nor after installation since the weight of the tubing is not imposed on the rubber bladder. Another approach is to hydraulically pressurize an annular rubber bladder in the hanger body by using a hand pump to cause the rubber bladder to squeeze around the circumference of the tubing. Disadvantages of this approach are relatively high cost and the need to use of a hand pump which makes it difficult to accurately adjust the pressure on the rubber bladder. Still another approach is to apply sealing pressure to an annular rubber bladder in the hanger body by imposing the weight of the inserted tubing thereon and mechanically tightening a plurality of circumferentially spaced beveled pins against a matching beveled slip bowl. The disadvantage of this approach is the integrity of the hanger body is compromised due to the holes formed therethrough which are necessary to accommodate the beveled adjustment pins. The hanger body may leak around the adjustment pins. Also, the wall thickness of the hanger body must be increased to accommodate the adjustment pins.

Consequently, a need exists for an alternative approach to hanging elongated tubing in the well bore such that a seal is formed at the well head about the tubing during its insertion into the bore, the seal is maintained after severance of the tubing from the reel, and the tubing is supported to prevent it from slipping further into the well bore after it is severed from the reel.

SUMMARY OF THE INVENTION

The present invention provides an assembly and method for hanging elongated tubing in the bore of a well designed to satisfy the aforementioned needs. The elongated tubing hanger assembly of the present invention basically comprises: (a) a bottom hanger sub for installation upright on the well head of a well; (b) a sealing assembly disposed in a first annular cavity formed within the bottom hanger sub; (c) an annular slip bowl disposed in a second annular cavity formed within the bottom hanger sub immediately above the first cavity, the slip bowl being seated on an upper end of the sealing assembly; (d) a slip element applied on the tubing and seated within the annular slip bowl such that the bottom hanger sub supports the tubing in the well bore via the slip element and sealing assembly; and (e) a top hanger sub attached into the upper end portion of the bottom hanger sub so as to apply a downward force via the slip bowl against the sealing assembly to cause compression and inward expansion thereof to form a seal around the tubing. The tubing hanger assembly also includes a running sub for temporary installation into an upper end portion of the bottom hanger sub during insertion of the tubing in the well bore. The top hanger sub is applied into the upper end portion of the bottom hanger sub after completion of insertion of the tubing in the well bore, removal of the running sub, and application of the slip element to the tubing.

The tubing hanger assembly may also include a retaining ring disposed in an outer annular recess defined about the upper periphery of the slip bowl and seated upon an annular shoulder defined on the slip bowl at the bottom of the annular recess so as to face toward an upper end of the slip bowl. The retaining ring is attached within the upper end of the bottom hanger sub and bears against the shoulder of the slip bowl so as to cause the slip bowl at a lower end thereof to engage the upper end of the sealing assembly and to apply a compressive force downward onto the sealing assembly causing it to expand radially inwardly and form a sliding seal about the circumference of the tubing inserted through the bottom hanger sub and the slip bowl and sealing assembly therein.

Also, the bottom hanger sub has an internal annular ledge which serves as a stop to downward movement of the slip bowl so as avoid the overinsertion of the running sub or top hanger sub that would apply an excessive compressive force on the sealing assembly via the slip bowl that would result in the sealing assembly applying a force on the tubing sidewall that would crush the tubing. Thus, the bottoming of the slip bowl in the bottom hanger sub limits the maximum force that can be applied via the slip bowl onto the sealing assembly from the force applied on the slip bowl either by the running sub during its temporary installation into an upper end portion of the bottom hanger sub or by the top hanger sub during its subsequent attachment into the upper end portion of the bottom hanger sub, after removal of the running sub. The bottoming of the slip bowl in the bottom hanger sub also prevents the weight of the tubing in the well bore from imposing too great a compressive force on the sealing assembly via slip bowl and the slip element.

Further, the sealing assembly includes at least one and preferably a pair of upper and lower annular seal elements, each made of a resiliently yieldable or compressible material such as rubber or the like, and at least one and preferably a pair of upper and lower rigid annular washers interposed respectively between and below the upper and lower annular seal elements and within the first annular cavity in the bottom hanger sub.

The elongated tubing hanging method of the present invention basically comprises the steps of: (a) providing a hanger assembly as described; (b) installing the running sub into the bottom hanger sub so as to cause the slip bowl to compress the sealing assembly to provide a sliding seal about the circumference of the tubing during insertion of the tubing; (c) after completion of insertion of the tubing in the well bore, applying the slip element to the tubing and seating the slip element in the slip bowl; (d) severing the tubing so as to permit the tubing to hang from the slip element into the well bore and the weight of the hanging tubing via the slip element to cause the slip bowl to compress the sealing assembly to maintain the sliding seal about the hanging tubing; and (e) removing the running sub and replacing it with the top hanger sub so as to cause the slip bowl to maintain the sealing assembly in the compressed sealing relationship with the tubing.

One feature of the present invention is that the elongated tubing is inserted through the components of the hanger assembly of the present invention into the well bore. An axial passage communicating with the well bore is defined through the bottom hanger sub, and slip bowl and sealing assembly disposed therein. The tubing is inserted, by use of a running tool or other means, through this passage into the well bore.

Another feature of the present invention is that the sliding seal is formed and maintained about the tubing by the sealing assembly as the tubing is inserted into the well bore. The sealing assembly includes a plurality of annular seal elements made of a resiliently yieldable material. The annular seal elements encompass the axial passage and the tubing being inserted therethrough. During insertion, the running sub is installed into the upper end portion of the bottom hanger sub. The running sub applies force downward against the slip bowl to compress and expand the annular seal elements radially inward into the sliding sealing relationship with the exterior of the tubing.

A further feature of the present invention is that the tubing is supported by the hanger assembly after it is severed from the reel. The slip element is applied to the tubing and is seated in a tapered opening defined through the slip bowl. The slip element is applied on the tubing at a location such that a desired length of tubing is hung therefrom and disposed in the well bore. Since the slip element fixedly engages and holds the tubing, the tubing is prevented from slipping further downward into the well bore after it is severed from the reel.

An additional feature of the present invention is that the retaining ring is used to apply at least a minimum level of compressive force on the sealing assembly so that the sealing assembly will maintain the sliding seal about the circumference of the tubing so as to make it impossible for well pressure to push the sealing assembly and slip bowl out of the bottom hanger sub after the coil tubing has been set at the desired depth in the well and the top hanger sub has been temporarily removed for some reason.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
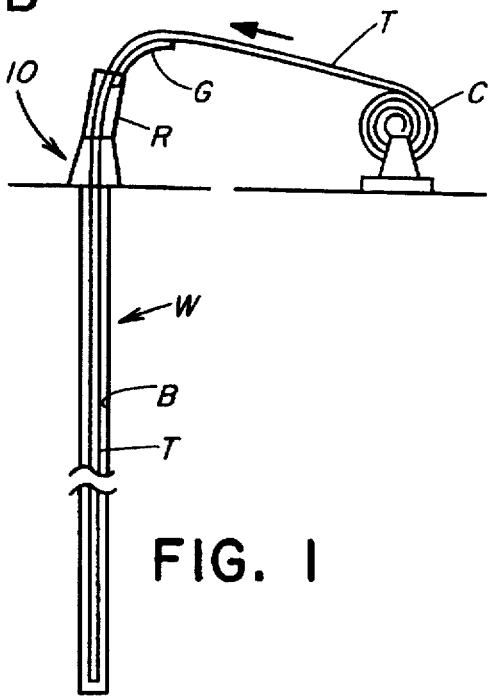
FIG. 1 is a schematic cross-sectional view showing elongated tubing being inserted through an elongated tubing hanger assembly of the present invention into a well bore of a well.

Referring to the drawings, and particularly to FIG. 1, there is illustrated an elongated tubing hanger assembly of the present invention, generally designated 10. The tubing hanger assembly 10 is installed on a well head H of a well W. A conventional running tool R (see also FIG. 2) is supported over the tubing hanger assembly 10 and is operable to receive elongated tubing T from a coil C thereof after routing over an arcuate-shaped guide G and to insert or run the tubing T through the assembly 10 and into the well bore B of the well W.

Figure 2B:
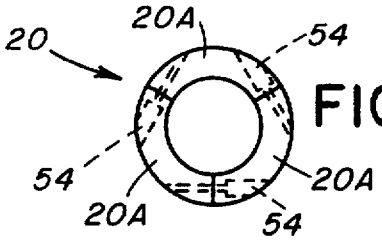
FIG. 2B is a top plan view of the slip element taken along line 2B—2B of FIG. 2.
Figure 2A:
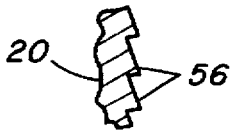
FIG. 2A is an enlarged detailed view of the portion of a slip element of the hanger assembly encompassed by circle 2A in FIG. 2.
Figure 2E:
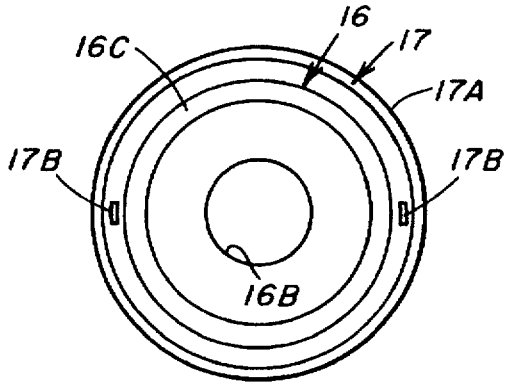
FIG. 2E is a top plan view of slip bowl and retaining ring as seen along line 2E—2E of FIG. 2D.
Figure 2D:
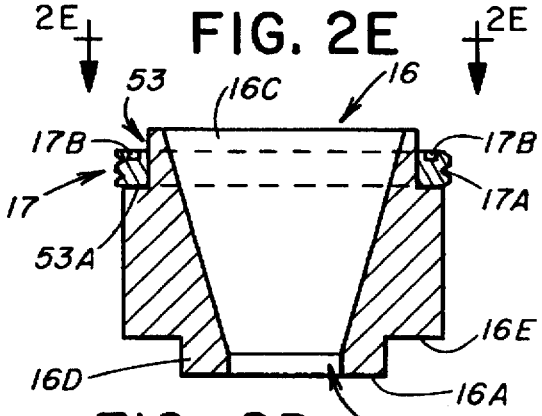
FIG. 2D is an enlarged axial sectional view of a slip bowl and retaining ring of the hanger assembly.
Figures 2, 2C:
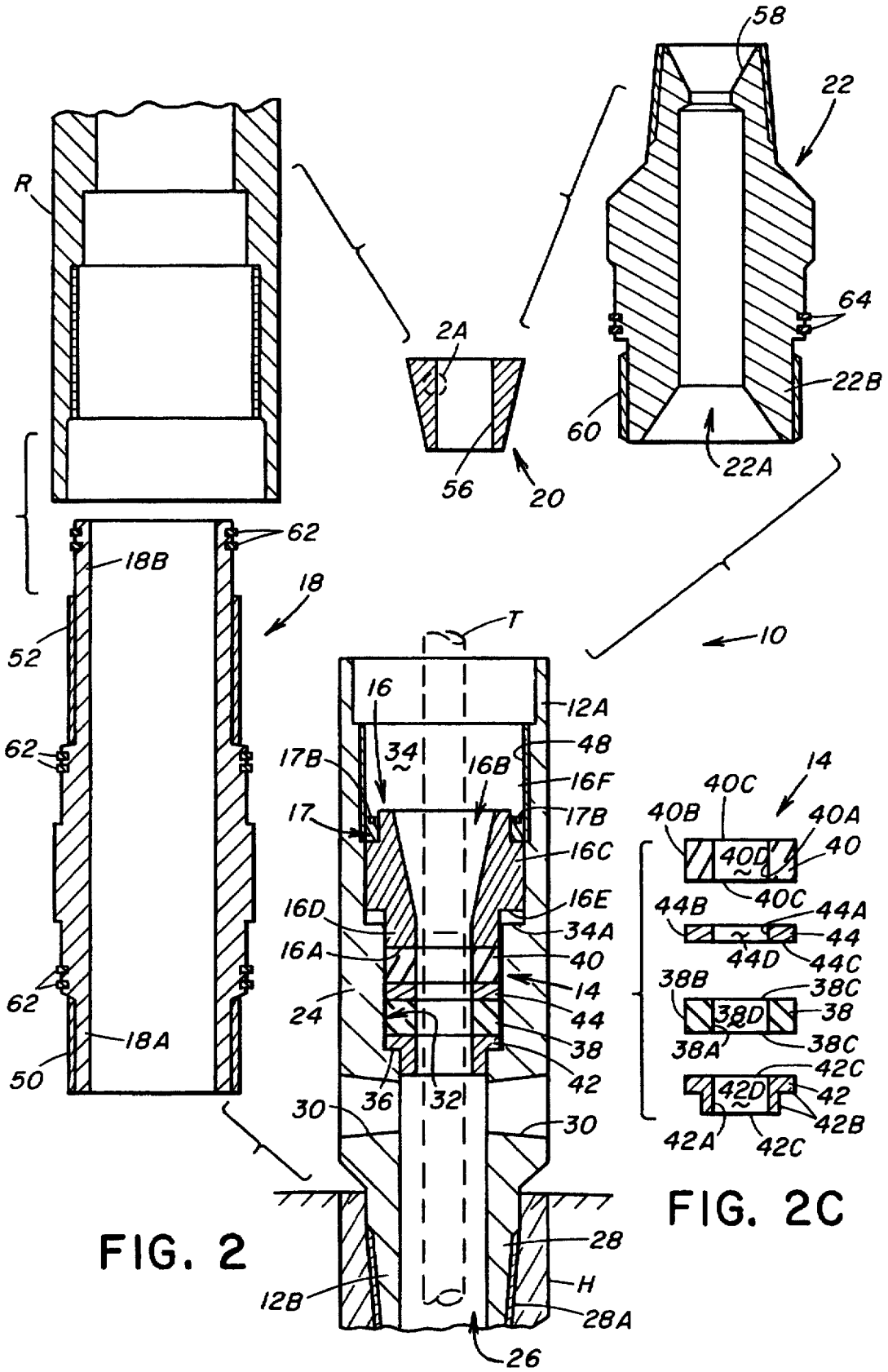
FIG. 2 is an enlarged exploded axial sectional view of the hanger assembly of the present invention.
FIG. 2C is an exploded axial sectional view of a sealing assembly of the hanger assembly.

Referring now to FIG. 2, the tubing hanger assembly 10 basically includes a bottom hanger sub 12 installed upright on the well head H, a sealing assembly 14 disposed within the bottom hanger sub 12, an annular slip bowl 16 disposed within the bottom hanger sub 12 immediately above the sealing assembly 14, an annular retaining ring 17 disposed about the upper periphery of the slip bowl 16, a running sub 18 for temporary installation into the bottom hanger sub 12 above the slip bowl 16, a slip element 20 applied on the tubing T and seated within the slip bowl 16 after insertion of the desired length of the tubing T into the well bore B is completed, and a top hanger sub 22 for attachment to the bottom hanger sub 12 after completion of insertion of the tubing T in the well bore B, removal of the running sub 18, and application of the slip element 20 to the tubing T.

The bottom hanger sub 12 of the hanger assembly 10 includes a generally cylindrical body 24 having a central passageway 26 extending axially through the bottom hanger sub 12 between and open at its opposite upper and lower ends 12A, 12B. The bottom hanger sub 12 also includes a lower end portion 28 being smaller in outside diameter than the main body 24 of the bottom hanger sub 12 and having external threads 28A formed therearound for securing the bottom hanger sub 12 into the upper end of the well head H so as to place the axial passageway 26 of the bottom hanger sub 12 in communication with the well bore B and adapt the bottom hanger sub 12 to receive therethrough elongated tubing T for insertion into the well bore B. Further, the bottom hanger sub 12 at locations above the lower end portion 28 thereof has a pair of opposite side ports 30 defined in the main body 24 which are utilized to attach the bottom hanger sub 12 to suitable emergency pressure relief equipment (not shown).

Also, the bottom hanger sub 12 has a first interior annular cavity 32 formed in the main body 24 immediately above the side ports 30 and a second interior annular cavity 34 formed in the main body 24 immediately above the first annular cavity 32. Both the first and second annular cavities 32, 34 encompass the axial passageway 26. Further, the first annular cavity 32 has a diameter larger than the diameter of the axial passageway 26, whereas the second annular cavity 34 has a diameter larger than both the first annular cavity 32 and axial passageway 26. Also, an interior annular shoulder 36 is formed in the main body 24 of the bottom hanger sub 12 at the bottom of the first interior annular cavity 32.

The sealing assembly 14 of the hanger assembly 10 includes at least one and preferably a pair of lower and upper annular seal elements 38, 40, each made of a resiliently yieldable or compressible material such as rubber or the like, and at least one and preferably a pair of lower and upper rigid annular spacers or washers 42, 44 interposed respectively below and between the lower and upper annular seal elements 38, 40 and within the first annular cavity 32. More specifically, as seen in FIG. 2C, the lower and upper annular seal elements 38, 40 are identical in size and construction, each having a pair of radially-spaced inner and outer concentric cylindrical surfaces 38A, 38B and 40A, 40B and a pair of axially-spaced side surfaces 38C, 40C extending between and connected with the inner and outer concentric cylindrical surfaces 38A, 38B and 40A, 40B. The lower and upper annular washers 42, 44 are not identical in size and construction, however. The upper washer 44 has a pair of radially-spaced inner and outer concentric cylindrical surfaces 44A, 44B and a pair of axially-spaced side surfaces 44C extending between and connected with the inner and outer concentric cylindrical surfaces 44A, 44B. On the other hand, the lower washer 42 has an inner cylindrical surface 42A and a pair of outer cylindrical surfaces 42B defined in side-by-side radially offset relationship with one another and concentric about the inner cylindrical surface 42A. The lower washer 42 also has a pair of axially-spaced side surfaces 42C extending between and connected with the inner cylindrical surface 42A and the remote ends of the pair of outer cylindrical surfaces 42B. The upper one of the outer surfaces 42B has a larger diameter than the lower one of the outer surfaces 42B so as to define an annular ledge 46 extending therebetween and facing downwardly toward and adapted to seat upon the interior annular shoulder 36 formed in the main body 24 of the bottom hanger sub 12 at the bottom of the first interior annular cavity 32.

Also, the seal elements 38, 40 and washers 42, 44 of the sealing assembly 14 have respective central openings 38D, 40D, 42D, 44D formed therethrough by the annular inner cylindrical surfaces 38A, 40A, 42A, 44A which are aligned coaxially with the axial passage 26 through the bottom hanger sub 12 such that the seal elements 38, 40 and washers 42, 44 extend about the elongated tubing T extending therethrough. Also, in their substantially uncompressed condition, as seen in FIG. 2, the seal elements 38, 40 have inside diameters which are at least slightly smaller than the inside diameters of the rigid washers 42, 44 so that the rigid washers 42, 44 will not make contact with the tubing T.

The annular slip bowl 16 of the tubing hanger assembly 10 is removably disposed within the second annular cavity 34 of the bottom hanger sub 12. A bottom end 16A of the slip bowl 16 engages and seats upon the upper annular seal element 40 at the upper end of the sealing assembly 14. The slip bowl 16 includes an opening 16B therethrough also encompassing the axial passage 26 through the bottom hanger sub 12 and the tubing T extending therethrough. Preferably, the exterior of the annular slip bowl 16 has a cylindrical configuration while the central opening 16B is conical in configuration with its widest portion facing upward. The slip bowl 16 also has an upper portion 16C which slidably mounts within the second annular cavity 34 and a lower portion 16D which slidably extends into the first annular cavity 32. An annular shoulder 16E extends between the respective exteriors of the upper and lower portions 16C, 16D of the slip bowl 16 which can bottom out against an annular ledge 34A defined in the bottom of the second annular cavity 34.

Figure 3:
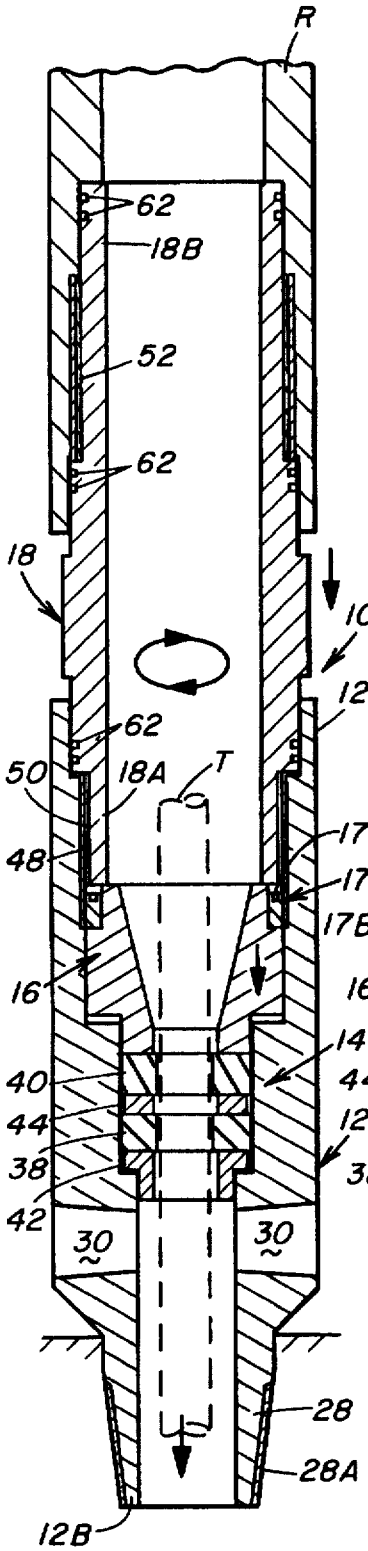
FIG. 3 is an axial sectional view showing a running sub installed into a bottom hanger sub of the hanger assembly.

The running sub 18 of the tubing hanger assembly 10 is provided for temporary installation into an upper end portion 12A of the bottom hanger sub 12. The running sub 18 is installed into the bottom hanger sub 12 for use during insertion of tubing T into the well bore B. When the running sub 18 is installed into the bottom hanger sub 12, it can be adjusted relative thereto to contact a top end 16F of the slip bowl 16 so as to apply a downwardly-directed force against the slip bowl 16 to compress and expand the annular seal elements 38, 40 of the sealing assembly 14 radially inwardly into a sliding sealing relationship with and about an exterior portion of the tubing T, as shown in FIG. 3. The annular seal elements 38, 40 also seal with respective adjacent interior annular portions of the bottom hanger sub 12 surrounding the annular seal elements 38, 40.

Preferably, a plurality of screw threads 48 are formed on an inner sidewall of the upper end portion 12A of the bottom hanger sub 12 and a plurality of screw threads 50 are formed on an outer sidewall of a lower end portion 18A of the running sub 18 for threaded engagement with the screw threads 48 of the bottom hanger sub 12 and tightening down of the running sub 18 against the slip bowl 16 to thereby apply the downward force via the slip bowl 16 against the sealing assembly 14. A plurality screw threads 52 are also formed about an outer sidewall of an upper end portion 18B of the running sub 18 so that it is adapted to engage a lower portion of a running tool R being used to insert the tubing into the well. The sets of screw threads 50, 52 are formed in opposing relationship such that by rotating the running sub 18 in one direction screws it into both the stationary bottom hanger sub 12 and the stationary running tool R, whereas rotating the running sub 18 in the opposite direction screws it out of both the stationary bottom hanger sub 12 and the stationary running tool R.

Referring to FIGS. 2, 2D, 2E and 3–6, the annular retaining ring 17 is disposed in an outer annular recess 53 defined about the upper periphery of the upper portion 16C of the slip bowl 16. The retaining ring 17 is seated upon an annular shoulder 53A defined on the slip bowl 16 at the bottom of the annular recess 53 so as to face toward an upper end of the slip bowl 16. The retaining ring 17 has external screw threads 17A which thread with the internal screw threads 48 on the upper end 12A of the bottom hanger sub 12. A cylindrical tool (not shown) having lower projections to fit into a pair of depressions 17B in the upper rim of the retaining ring 17 is used to rotate the ring 17 and screw it into the bottom hanger sub 12 so that the ring 17 bears downward against the annular shoulder 53A of the slip bowl 16 so as to force the slip bowl 16 at the lower portion 16D thereof into engagement with the upper end of the sealing assembly 14 and thereby apply a compressive force downward onto the sealing assembly 14 causing its seal elements 38, 40 to expand radially inward and form the sliding seal about the circumference of the tubing T inserted through the bottom hanger sub 12 and the slip bowl 16 and sealing assembly 14 therein. The ring 17 is used to apply at least a minimum level of compressive force on the sealing assembly 14 so that the sealing assembly 14 will maintain the sliding seal about the circumference of the tubing T so as to prevent well pressure from pushing the sealing assembly 14 and slip bowl 16 out of the bottom hanger sub 12 after the coil tubing T has been set at the desired depth in the well W and the top hanger sub 22 has been temporarily removed for some reason.

Figure 4:
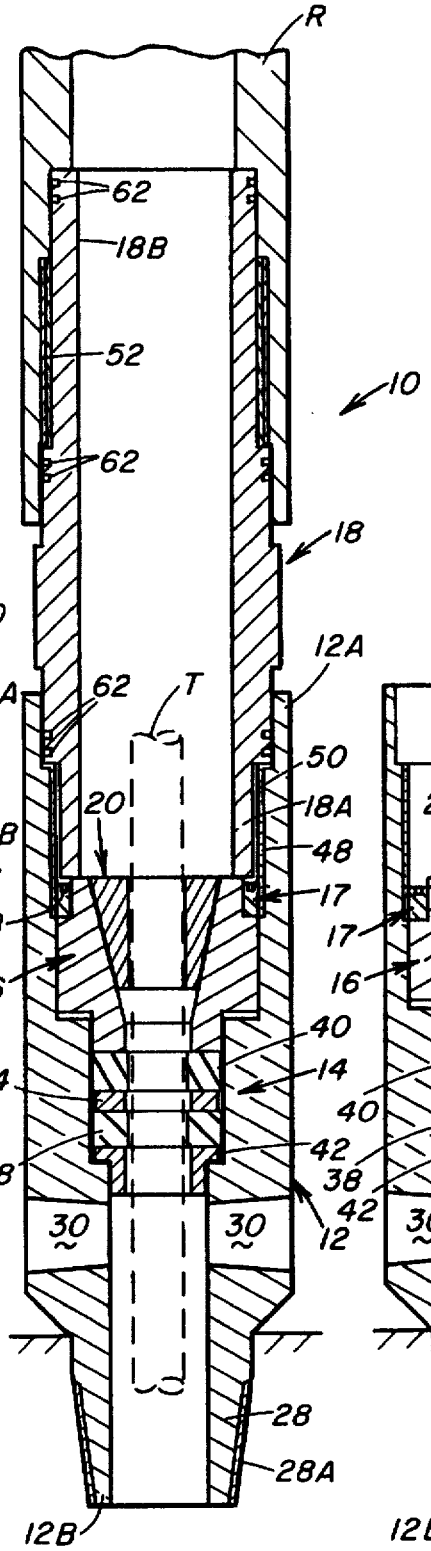
FIG. 4 is an axial sectional view showing the hanger assembly after application of a slip element to the tubing.
Figure 5:
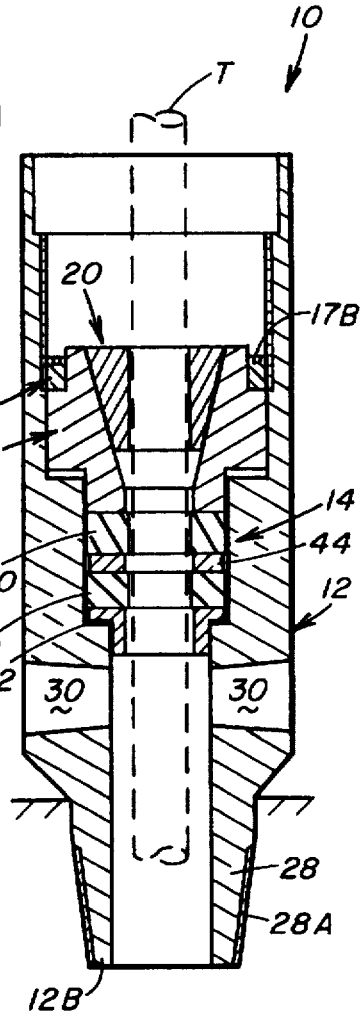
FIG. 5 is an axial sectional view showing the hanger assembly after removal of the running sub from the bottom hanger sub.

Referring to FIGS. 2, 2A, 2B and 4–6, the slip element 20 of the tubing hanger assembly 10 has an exterior conical configuration matching the conical configuration of the central opening 16B in the slip bowl 16 so that the slip element 20 will seat therein. When the slip element 20 is applied on the tubing T and seated in the opening 16B, the tubing T hangs therefrom downwardly into the well bore B. The narrowest portion of the conical-shaped slip element 20 faces downward to adapt it for seating in the conical-shaped opening 16B with its widest portion facing upward. As seen in FIG. 2A, the slip element 20 is formed of angular segments 20A which are attached together by fasteners 54. Also, as seen in FIG. 2B, the slip element 20 has a plurality of screw threads 56 formed on an inner sidewall of an opening therethrough for engaging an exterior portion of the tubing T. In addition to hanging the tubing T in the well bore B, the slip element 20 also applies downward force from the weight of the tubing T to the slip bowl 16 to compress and expand the annular seal elements 38, 40 of the sealing assembly 14 radially inward into the sealing relationship with the exterior of the tubing T. Thus, once the slip element 20 is applied to the tubing T and seated in the opening 16A of the slip bowl 16, the running sub 18 can be removed without breaking the sealed relationship between the annular seal elements 38, 40 and the tubing T as is shown in FIG. 5.

Figure 6:
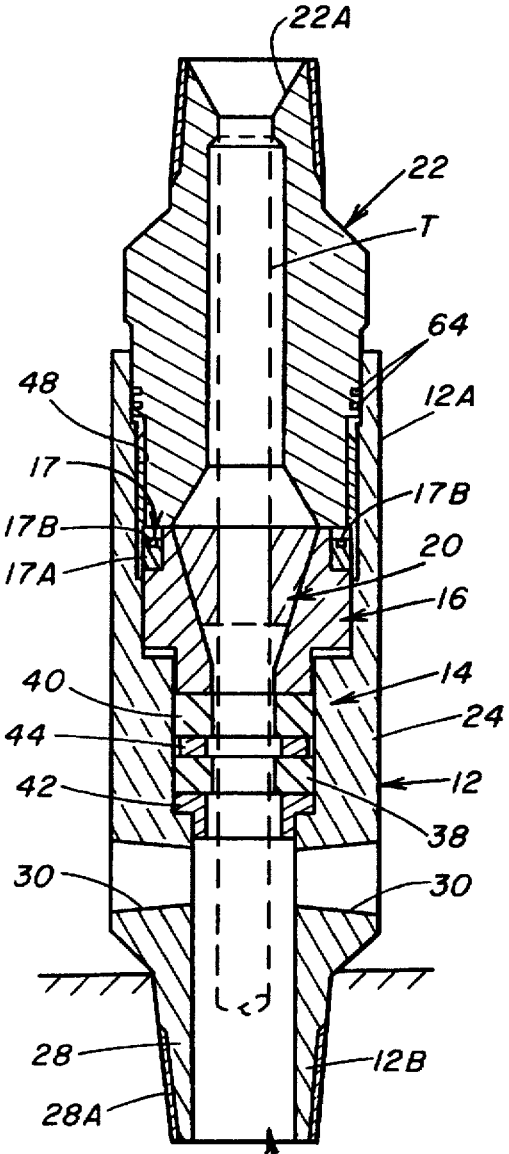
FIG. 6 is an axial sectional view showing the hanger assembly after installation of a top hanger sub into the bottom hanger sub.

Finally, the top hanger sub 22 of the tubing hanger assembly 10 is provided for attachment to the upper end portion 12A of the bottom hanger sub 12 after completion of insertion of the tubing T into the well bore B and application of the slip element 20 to the tubing T as is shown in FIG. 6. The top hanger sub 22 includes a central bore 22A for receiving the elongated tubing T therethrough. Preferably, a conical-shaped mouth 58 is defined in an upper end of the top hanger sub 22 and the slip element 20 is applied on the tubing T near an upper end thereof and seated into the opening 16B of the slip bowl 16 such that the tubing T extends upwardly through the central bore 22A of the top hanger sub 22 and terminates immediately below the conical-shaped mouth 58. As with the running sub 22, a plurality of screw threads 60 are preferably formed on an outer sidewall of a lower end portion 22B of the top hanger sub 22 for threaded engagement with screw threads 48 formed on the inner sidewall of the upper end portion 12A of the bottom hanger sub 12. With such screw threads 50, the top hanger sub 22 can be tightened down against the slip bowl 16 to apply force in addition to that which is supplied by the weight of the tubing T to compress and expand the annular seal elements 38, 40 of the sealing assembly 14 radially inward to augment the sealing relationship with the exterior of the tubing T. It should be noted that three pairs of O-ring seals 62 are provided on the running sub 18 adjacent to the screw threads 50, 52 thereon for forming seals with respective adjacent interior annular portions of the running tool R and bottom hanger sub 12. Also, one pair of O-ring seals 64 is provided on the top hanger sub 22 adjacent to the screw threads 48 for forming seals with adjacent interior annular portions of the bottom hanger sub 12.

Referring now to FIGS. 2–6, there is illustrated the assembled condition of the tubing hanger assembly 10 after successive steps of the method of installation thereof in accordance with the present invention. As depicted in FIG. 2, the first step of the installation method involves providing the components of the tubing hanger assembly 10 as described above and installing the bottom hanger sub 12 upright on the well head H so that the axial passage 26 communicates with the well bore B of the well W. As shown by the arrows in FIG. 3, the second step of the installation method involves threading the running sub 18 into the upper end portion 12A of the bottom hangar sub 12 and tightening it sufficiently to apply the desired force downward against the slip bowl 16 to compress and expand the annular seal elements 38, 40 of the sealing assembly 20 radially inward into the sliding sealing relationship with the exterior portion of the tubing T. When a desired length of tubing T has been run into the well bore B, the slip element 20 is attached to the tubing T and seated in the opening 16B of the slip bowl 16. Upon completion of this step, the hanger assembly 10 is as depicted in FIG. 4. Since the tubing T is now supported and prevented from slipping further downward into the well bore B by the slip element 20 and a minimum level of downward force is applied by the retaining ring 17 via the slip bowl 16 against the sealing assembly 14 maintaining the annular seal elements 38, 40 of the sealing assembly 14 compressed and expanded radially inward in the sealing relationship with the exterior portion of the tubing T, the tubing T can be severed at its upper end from the coil C and the running sub 22 unscrewed and removed from the running tool R and the bottom hanger sub 12 as is shown in FIG. 5. With the running sub 22 removed, the top hanger sub 22 is now threaded into the upper end portion 12A of the bottom hanger sub 12 and tightened against the slip bowl 16 to apply additional force against the slip bowl 16, if desired, to further compress and expand the annular seal elements 38, 40 of the sealing assembly 14 radially inward so as to augment the their sealing relationship with the exterior of the tubing T. Upon completion of this final step, the hanger assembly 10 is as depicted in FIG. 6.

The retaining ring 17 is used to apply at least a minimum level of compressive force on the sealing assembly 14 so that the sealing assembly 14 will maintain the sliding seal about the circumference of the tubing T so as to make it impossible for well pressure to push the sealing assembly 14 and slip bowl 16 upwardly out of the bottom hanger sub 12 after the coil tubing T has been set at the desired depth in the well W and the top hanger sub 22 has been temporarily removed for some reason. Also, the internal annular ledge 34A in the bottom hanger sub 12 serves as a stop to the downward movement of the slip bowl 16 so as avoid the overinsertion of the running sub 18 or top hanger sub 22 that would apply an excessive compressive force on the sealing assembly 14 via the slip bowl 16 that would result in the sealing assembly 14 applying a force on the tubing sidewall that would crush the tubing T. Thus, the bottoming of the slip bowl 16 in the bottom hanger sub 12 limits the maximum force that can be applied via the slip bowl 16 onto the sealing assembly 14 from the force applied on the slip bowl 16 either by the running sub 18 during temporary installation into an upper end portion of the bottom hanger sub 12 or by the top hanger sub 22 during subsequent attachment into the upper end portion of the bottom hanger sub 12, after removal of the running sub 18. The bottoming of the slip bowl 16 in the bottom hanger sub 12 also prevents the weight of the tubing T in the well bore W from imposing an excessive compressive force on the sealing assembly 14 via slip bowl 16 and slip element 20.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An elongated tubing hanger assembly for hanging elongated tubing in a bore of a well, said hanger assembly comprising:

(a) a bottom hanger sub adapted for installation upright on a well head of a well, said bottom hanger sub including
  (i) an axial passage communicating with a well bore of the well and adapted to receive therethrough elongated tubing for insertion into the well bore,
  (ii) a first annular cavity encompassing said axial passageway, and
  (iii) a second annular cavity located above said first annular cavity and encompassing said axial passage;

(b) a sealing assembly including a pair of annular seal elements made of a resiliently yieldable compressible material and a pair of rigid annular washers interposed between and below said annular seal elements, said annular seal elements and annular washers being disposed within said first annular cavity and encompassing said axial passageway, said annular seal elements and annular washers having respective openings receiving therethrough the elongated tubing inserted through said axial passageway;

(c) an annular slip bowl disposed within said second cavity and encompassing said axial passageway, said annular slip bowl applying a force on an upper end of said sealing assembly and having an opening receiving therethrough the elongated tubing inserted through said axial passage;

(d) a slip element having an opening and being adapted for attachment about the elongated tubing with the elongated tubing extending through said opening of said slip element, said slip element being adapted to seat in said opening of said slip bowl and support the elongated tubing in the well bore such that the weight of the elongated tubing is thereby supported by said slip element on said slip bowl and a downward force from the weight of the tubing is applied to said slip bowl to compress and expand said annular seal elements of said sealing assembly radially inward into a sealing relationship about and with an exterior portion of the tubing; and (e) a top hanger sub including a central bore for receiving the tubing therethrough, said top hanger sub being attached to said upper end portion of said bottom hanger sub and adjustable relative thereto to contact an upper end of said slip bowl so as to apply a downward force via said slip bowl against said annular seal elements of said sealing assembly to cause compression and inward expansion thereof to augment said sealing relationship of said annular seal elements about and with the exterior portion of the tubing.

2. The hanger assembly of claim 1 wherein said sealing assembly is slidably and removably mounted in said first annular cavity of said bottom hanger sub.

3. The hanger assembly of claim 1 wherein said bottom hanger sub includes an annular shoulder formed at a bottom of said first annular cavity, a lower one of said pair of rigid annular washers being seated on said annular shoulder.

4. The hanger assembly of claim 1 wherein said central bore through said top hanger sub extends downward from a conical shaped mouth defined in an upper end thereof such that the tubing extends upwardly through said central bore and terminates immediately below said conical shaped mouth.

5. The hanger assembly of claim 1 wherein:

said bottom hanger sub has an upper end portion with a plurality of screw threads being formed on an inner sidewall thereof; and said top hanger sub has a lower end portion with a plurality of screw threads being formed on an outer sidewall of said lower end portion thereof for engagement with said internal screw threads of said bottom hanger sub and for tightening down of said top hanger sub against said slip bowl to compress and expand said annular seal element of said sealing assembly radially inward into said sealing relationship aroung the exterior portion of the elongated tubing.

6. The hanger assembly of claim 1 wherein said opening in said slip bowl is conical shaped having its widest portion facing upward and said slip element is conical shaped having its narrowest portion facing downward.

7. The hanger assembly of claim 6 wherein said central bore through said top hanger sub extends downward from a conical shaped mouth defined in an upper end thereof and said slip element is applied on the tubing near an upper end thereof and seated into said conical shaped opening in said slip bowl such that the tubing extends upwardly through said central bore and terminates immediately below said conical shaped mouth.

8. The hanger assembly of claim 1 wherein said slip element includes a plurality of threads formed on an inner sidewall defining said opening therethrough for engaging the exterior portion of the tubing.

9. The hanger assembly of claim 1 wherein said bottom hanger sub has an internal annular ledge which serves as a stop to downward movement of said slip bowl so as to prevent said top hanger sub from applying an excessive compressive force on said sealing assembly via said slip bowl that would result in said sealing assembly, in turn, applying a force on the tubing that would crush the tubing.

10. An elongated tubing hanger assembly for hanging elongated tubing in a bore of a well, said hanger assembly comprising:

(a) a bottom hanger sub adapted for installation upright on a well head of a well, said bottom hanger sub including
  (i) an axial passage communicating with a well bore of the well and adapted to receive therethrough elongated tubing for insertion into the well bore,
  (ii) a first annular cavity encompassing said axial passageway, and
  (iii) a second annular cavity located above said first annular cavity and encompassing said axial passage;

(b) a sealing assembly including at least one annular seal element made of a resiliently yieldable compressible material and being disposed within said first annular cavity and encompassing said axial passageway, said annular seal element having an opening receiving therethrough the elongated tubing inserted through said axial passageway;

(c) an annular slip bowl disposed within said second cavity and encompassing said axial passageway, said annular slip bowl applying a force on an upper end of said annular seal element and having an opening receiving therethrough the elongated tubing inserted through said axial passage;

(d) a slip element having an opening and being adapted for attachment about the elongated tubing with the elongated tubing extending through said opening of said slip element, said slip element being adapted to seat in said opening of said slip bowl and support the elongated tubing in the well bore such that the weight of the elongated tubing is thereby supported by said slip element on said slip bowl and a downward force from the weight of the tubing is applied to said slip bowl to compress and expand said annular seal element of said sealing assembly radially inward into a sealing relationship about and with an exterior portion of the tubing;

(e) a top hanger sub including a central bore for receiving the tubing therethrough, said top hanger sub being attached to said upper end portion of said bottom hanger sub and adjustable relative thereto to contact an upper end of said slip bowl so as to apply a downward force via said slip bowl against said annular seal element of said sealing assembly to cause compression and inward expansion thereof to augment said sealing relationship of said annular seal element about and with the exterior portion of the tubing; and (f) an annular retaining ring disposed in an outer annular recess defined about an upper periphery of said slip bowl and seated upon an annular shoulder defined on said slip bowl in said annular recess, said retaining ring being attached within said upper end portion of said bottom hanger sub and bearing against said shoulder of said slip bowl so as to cause said slip bowl at a lower end thereof to engage an upper end of said sealing assembly and to apply a compressive force downward onto said sealing assembly causing it to expand radially inwardly and form said sliding seal about the circumference of the tubing inserted through said bottom hanger sub and said slip bowl and sealing assembly therein.

11. The hanger assembly of claim 10 wherein said sealing assembly includes a pair of said annular seal elements and a pair of rigid annular washers interposed respectively between and below said annular seal elements.

12. An elongated tubing hanger assembly for hanging elongated tubing in a bore of a well, said hanger assembly comprising:

(a) a bottom hanger sub adapted for installation upright on a well head of a well, said bottom hanger sub including (i) an axial passage communicating with a well bore of the well and adapted to receive therethrough elongated tubing for insertion into the well bore, (ii) a first annular cavity encompassing said axial passageway, and (iii) a second annular cavity located above said first annular cavity and encompassing said axial passage;

(b) a sealing assembly including at least one annular seal element made of a resiliently yieldable compressible material and being disposed within said first annular cavity and encompassing said axial passageway, said annular seal element having an opening receiving therethrough the elongated tubing inserted through said axial passageway;

(c) an annular slip bowl disposed within said second cavity and encompassing said axial passageway, said annular slip bowl applying a downward force on an upper end of said annular seal element and having an opening receiving therethrough the elongated tubing inserted through said axial passage;

(d) a running sub adapted for temporary installation into an upper end portion of said bottom hanger sub and being adjustable relative thereto to contact an upper end of said annular slip bowl so as to apply a downward force via said slip bowl against said annular seal element of said sealing assembly to cause compression and radially inward expansion thereof into a sliding sealing relationship about and with an exterior portion of the elongated tubing as it is being inserted downward through said axial passage of said bottom hanger sub and said openings of said annular seal element and said slip bowl;

(e) a slip element having an opening and being adapted for attachment about the elongated tubing with the elongated tubing extending through said opening of said slip element, said slip element being adapted to seat in said opening of said slip bowl and support the elongated tubing in the well bore such that the weight of the elongated tubing is thereby supported by said slip element on said slip bowl and a downward force from the weight of the tubing is applied to said slip bowl to compress and expand said annular seal element of said sealing assembly radially inward into said sliding sealing relationship with and about the exterior portion of the tubing; and (f) a top hanger sub including a central bore for receiving the tubing therethrough and for attachment to said upper end portion of said bottom hanger sub after completion of insertion of the tubing in the well bore, removal of said running sub, and attachment of said slip element to the tubing, said top hanger sub being adjustable relative to said bottom hanger sub and adapted to apply a downward force via said slip bowl against said annular seal element of said sealing assembly to cause compression and inward expansion thereof to augment said sealing relationship of said annular seal element with and around the exterior portion of the tubing.

13. The hanger assembly of claim 12 wherein said sealing assembly is slidably and removably mounted in said first annular cavity of said bottom hanger sub.

14. The hanger assembly of claim 12 wherein said sealing assembly includes a pair of said annular seal elements and a pair of rigid annular washers interposed respectively between and below said annular seal elements.

15. The hanger assembly of claim 14 wherein said bottom hanger sub includes an annular shoulder formed at a bottom of said first annular cavity, a lower one of said pair of rigid annular washers being seated on said annular shoulder.

16. The hanger assembly of claim 12 wherein:

said bottom hanger sub has an upper end portion with a plurality of screw threads being formed on an inner sidewall thereof; and said running sub has a lower end portion with a plurality of screw threads being formed on an outer sidewall of said lower end portion thereof for engagement with said internal screw threads of said bottom hanger sub and tightening down of said running sub against said slip bowl to compress and expand said annular seal element of said sealing assembly radially inward into said sliding sealing relationship with the exterior portion of the elongated tubing as it is being inserted downward through said axial passageway of said bottom hanger sub.

17. The hanger assembly of claim 16 wherein said running sub further includes a plurality screw threads formed about an outer sidewall of an upper end portion thereof such that said running sub is adapted to engage a lower end of a running tool being used to insert the tubing into the well.

18. The hanger assembly of claim 12 wherein said, opening in said slip bowl is conical shaped having its widest portion facing upward and said slip element is conical shaped having its narrowest portion facing downward.

19. The hanger assembly of claim 12 wherein said slip element includes a plurality of threads formed on an inner sidewall defining said opening therethrough for engaging the exterior portion of the tubing.

20. The hanger assembly of claim 12 wherein said central bore through said top hanger sub extends downward from a conical shaped mouth defined in an upper end thereof and said slip element is applied on the tubing near an upper end thereof and seated into said conical shaped opening in said slip bowl such that the tubing extends upwardly through said central bore and terminates immediately below said conical shaped mouth.

21. The hanger assembly of claim 12 further comprising:

an annular retaining ring disposed in an outer annular recess defined about an upper periphery of said slip bowl and seated upon an annular shoulder defined on said slip bowl in said annular recess, said retaining ring being attached within said upper end portion of said bottom hanger sub and bearing against said shoulder of said slip bowl so as to cause said slip bowl at a lower end thereof to engage an upper end of said sealing assembly and to apply a compressive force downward onto said sealing assembly causing it to expand radially inwardly and form said sliding seal about the circumference of the tubing inserted through said bottom hanger sub and said slip bowl and sealing assembly therein.

22. The hanger assembly of claim 12 wherein said bottom hanger sub has an internal annular ledge which serves as a stop to downward movement of said slip bowl so as to prevent said top hanger sub from applying an excessive compressive force on said sealing assembly via said slip bowl that would result in said sealing assembly, in turn, applying a force on the tubing that would crush the tubing.

23. A method of hanging elongated tubing in a well bore of a well, said method comprising the steps of:

(a) providing an elongated tubing hanger assembly including (i) a bottom hanger sub having an axial passage therethrough adapted to receive the tubing for insertion into the well bore, (ii) a sealing assembly including at least one annular seal element made of a resiliently yieldable compressible material disposed about said axial passage within a first annular cavity of said bottom hanger sub, (iii) an annular slip bowl removably disposed within said second cavity and seated upon an upper end of said sealing assembly, said slip bowl including an opening therethrough encompassing said axial passage, (iv) a running sub for temporary installation into an upper end portion of said bottom hanger sub, (v) a slip element for attachment on the tubing, and (vi) a top hanger sub including a central bore for receiving the tubing therethrough and for attachment to said upper end portion of said bottom hanger sub;

(b) installing said bottom hanger sub upright on the well head of the well such that said axial passage communicates with the well bore;

(c) installing said running sub into said upper end portion of said bottom hanger sub such that it applies force downward against said slip bowl to compress and expand said annular seal element of said sealing assembly radially inward into a sliding sealing relationship with and about an exterior portion of the tubing as it is being inserted downward through said axial passage of said bottom hanger sub;

(d) attaching said slip element to the tubing and seating said slip element in said opening of said slip bowl such that the tubing is supported by said slip element and slip bowl in the well bore and a downward force due to the weight of the tubing is applied to said slip bowl to compress and expand said annular seal element of said sealing assembly radially inward into said sliding sealing relationship with and about the exterior portion of the tubing.

24. The method of claim 23 further comprising the steps of:

(e) removing said running sub from said bottom hanger sub after said attachment of said slip element to said tubing and seating of said slip element in said opening of said slip bowl; and (f) installing said top hanger sub into said upper end portion of said bottom hanger sub after removal of said running sub such that said top hanger sub applies a downward force against said slip bowl to compress and expand said annular seal element of said sealing assembly radially inward so as to augment said sealing relationship of said annular seal element with and about the exterior portion of the tubing.

25. An elongated tubing hanger assembly for hanging elongated tubing in a bore of a well, said hanger assembly comprising:

(a) a bottom hanger sub adapted for installation upright on a well head of a well, said bottom hanger sub including (i) an axial passage communicating with a well bore of the well and adapted to receive therethrough elongated tubing for insertion into the well bore, (ii) a first annular cavity encompassing said axial passageway, and (iii) a second annular cavity located above said first annular cavity and encompassing said axial passage;

(b) a sealing assembly including at least one annular seal element made of a resiliently yieldable compressible material and at least one rigid annular washer disposed below said annular seal element, said annular seal element and annular washer being disposed within said first annular cavity and encompassing said axial passageway, said annular seal element and annular washer having respective central openings receiving therethrough the elongated tubing inserted through said axial passageway, said central opening of said annular seal element in an uncompressed state having a diameter at least slightly smaller than a diameter of said central opening of said annular washer so that said annular washer will not make contact with the elongated tubing inserted through said openings of said annular seal element and annular washer;

(c) an annular slip bowl disposed within said second cavity and encompassing said axial passageway, said annular slip bowl applying a force on an upper end of said annular seal element and having an opening receiving therethrough the elongated tubing inserted through said axial passage;

(d) a slip element having an opening and being adapted for attachment about the elongated tubing with the elongated tubing extending through said opening of said slip element, said slip element being adapted to seat in said opening of said slip bowl and support the elongated tubing in the well bore such that the weight of the elongated tubing is thereby supported by said slip element on said slip bowl and a downward force from the weight of the tubing is applied to said slip bowl to compress and expand said annular seal element of said sealing assembly radially inward into a sealing relationship about and with an exterior portion of the tubing; and (e) a top hanger sub including a central bore for receiving the tubing therethrough, said top hanger sub being attached to said upper end portion of said bottom hanger sub and adjustable relative thereto to contact an upper end of said slip bowl so as to apply a downward force via said slip bowl against said annular seal element of said sealing assembly to cause compression and inward expansion thereof to augment said sealing relationship of said annular seal element about and with the exterior portion of the tubing.

* * * * *